US011229279B1

(12) United States Patent
Spells et al.

(10) Patent No.: US 11,229,279 B1
(45) Date of Patent: Jan. 25, 2022

(54) PERSONAL HYDRATION ASSEMBLY

(71) Applicants: Darvae Spells, Indianapolis, IN (US); Nigel Foreman, Indianapolis, IN (US); Benjamin Hughes, Indianapolis, IN (US); Steve Summerville, Indianapolis, IN (US)

(72) Inventors: Darvae Spells, Indianapolis, IN (US); Nigel Foreman, Indianapolis, IN (US); Benjamin Hughes, Indianapolis, IN (US); Steve Summerville, Indianapolis, IN (US)

( * ) Notice: Subject to any disclaimer, the term of this patent is extended or adjusted under 35 U.S.C. 154(b) by 0 days.

(21) Appl. No.: 17/077,309

(22) Filed: Oct. 22, 2020

(51) Int. Cl.
*A45F 3/16* (2006.01)

(52) U.S. Cl.
CPC ..... *A45F 3/16* (2013.01); *A45F 2003/166* (2013.01)

(58) Field of Classification Search
CPC ..... A45F 2003/163; A45F 2003/205; A45F 3/18; A45F 2200/0583; A45F 2003/166; A45F 3/16; A45F 3/20; A45F 3/04; A61J 1/2093; B67D 1/0871
USPC ..... 224/148.2
See application file for complete search history.

(56) References Cited

U.S. PATENT DOCUMENTS

| | | | | |
|---|---|---|---|---|
| 4,544,087 | A * | 10/1985 | Modig | A45F 3/16 224/148.2 |
| 4,948,023 | A * | 8/1990 | Tripp | A45F 3/16 222/175 |
| 5,722,573 | A | 3/1998 | Carnel | |
| 6,283,344 | B1 | 9/2001 | Bradley | |
| 6,990,860 | B1 * | 1/2006 | Gillanders | A45F 3/20 222/175 |
| D587,007 | S | 2/2009 | Phillips, III | |
| 7,631,672 | B2 | 12/2009 | Spencer | |
| 7,806,300 | B1 | 10/2010 | Noell | |
| 10,161,779 | B2 * | 12/2018 | Lazzi | G01F 23/268 |
| 10,421,655 | B1 | 9/2019 | Steele | |
| 10,962,399 | B1 * | 3/2021 | Rumler | G01F 23/248 |
| 2004/0118942 | A1 * | 6/2004 | Courtney | B63C 9/1255 239/302 |
| 2007/0090135 | A1 * | 4/2007 | Benham | A45F 3/20 224/148.2 |
| 2019/0233068 | A1 * | 8/2019 | Socarras | B63C 9/11 |
| 2020/0054116 | A1 * | 2/2020 | Sola | G01F 23/0007 |

FOREIGN PATENT DOCUMENTS

| | | |
|---|---|---|
| WO | WO2006115719 | 11/2006 |

* cited by examiner

*Primary Examiner* — Nathan J Newhouse
*Assistant Examiner* — Matthew T Theis

(57) ABSTRACT

A personal hydration assembly includes a pair of reservoirs that each respectively contains water or fluid electrolytes and each of the reservoirs is removably attachable together. A pair of shoulder straps is each coupled to a respective one of the reservoirs and each of the shoulder straps can be extended over the user's shoulders thereby facilitating the pair of reservoirs to be worn on the user's back. A pair of drinking tubes is each in fluid communication with a respective one of the reservoirs thereby facilitating the user to drink either the water or the fluid electrolytes. A pair of waist belts is each attached to a respective one of the reservoirs for wearing around the user's waist when the shoulder straps are worn over the user's shoulders.

15 Claims, 5 Drawing Sheets

PERSONAL HYDRATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hydration devices and more particularly pertains to a new hydration device for PURPOSE.

(2) Description of Related Art Including Information Disclosed Under 37 CFR 1.97 and 1.98

The prior art relates to hydration devices including a variety of pouches that are wearable over a user's shoulder which can contain a beverage and a tube fluidly coupled to the pouch for drinking the beverage. The prior art also discloses a drinking tube that can be attached to a bicycle helmet thereby facilitating hands free drinking while riding a bicycle. The prior art discloses a hydration unit that is integrated into a pair of football shoulder pads. The prior art discloses a hydration backpack that includes a pump for pumping a beverage to a user during strenuous activities.

BRIEF SUMMARY OF THE INVENTION

An embodiment of the disclosure meets the needs presented above by generally comprising a pair of reservoirs that each respectively contains water or fluid electrolytes and each of the reservoirs is removably attachable together. A pair of shoulder straps is each coupled to a respective one of the reservoirs and each of the shoulder straps can be extended over the user's shoulders thereby facilitating the pair of reservoirs to be worn on the user's back. A pair of drinking tubes is each in fluid communication with a respective one of the reservoirs thereby facilitating the user to drink either the water or the fluid electrolytes. A pair of waist belts is each attached to a respective one of the reservoirs for wearing around the user's waist when the shoulder straps are worn over the user's shoulders.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
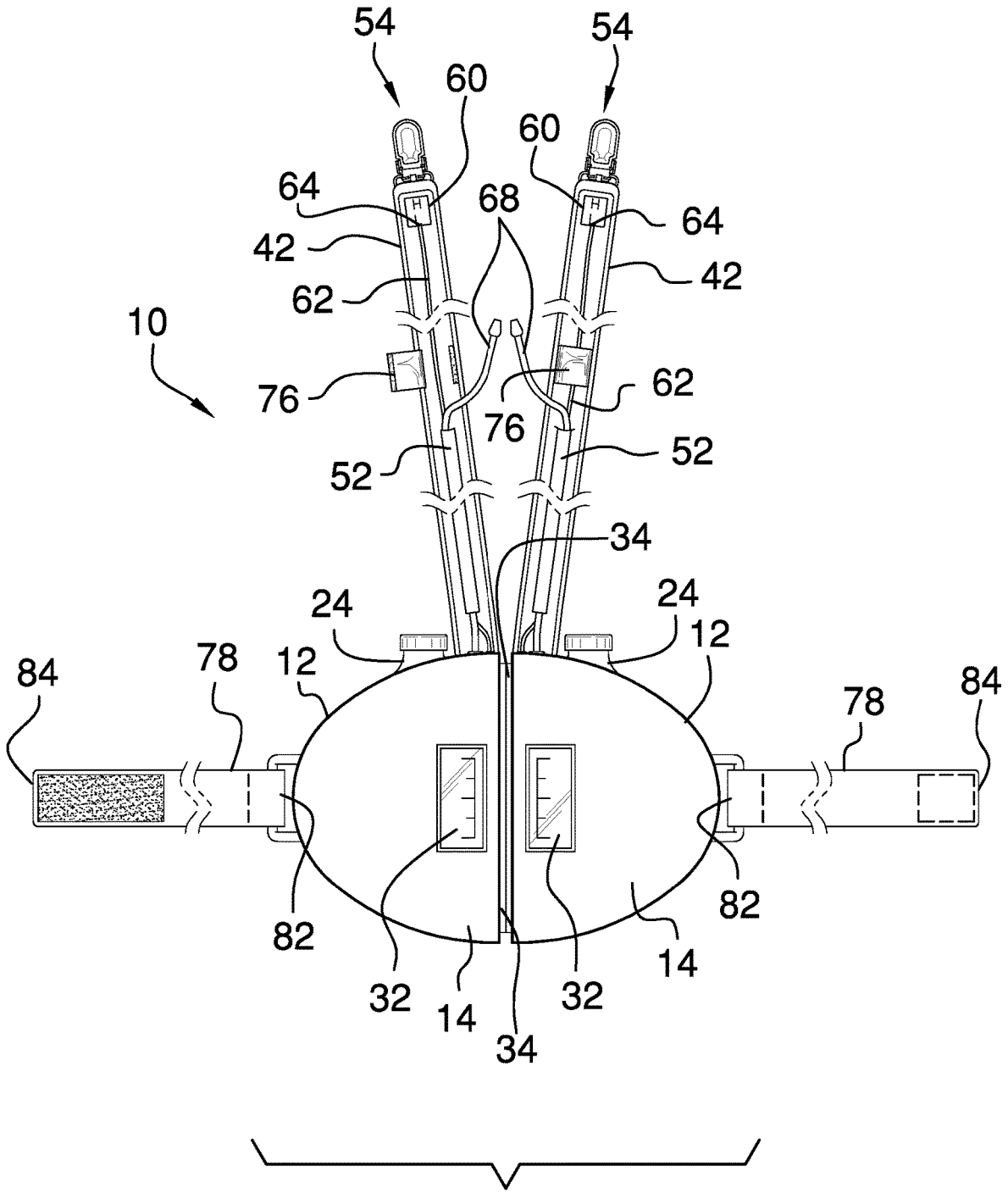
FIG. 1 is a front view of a personal hydration assembly according to an embodiment of the disclosure.
Figure 2:
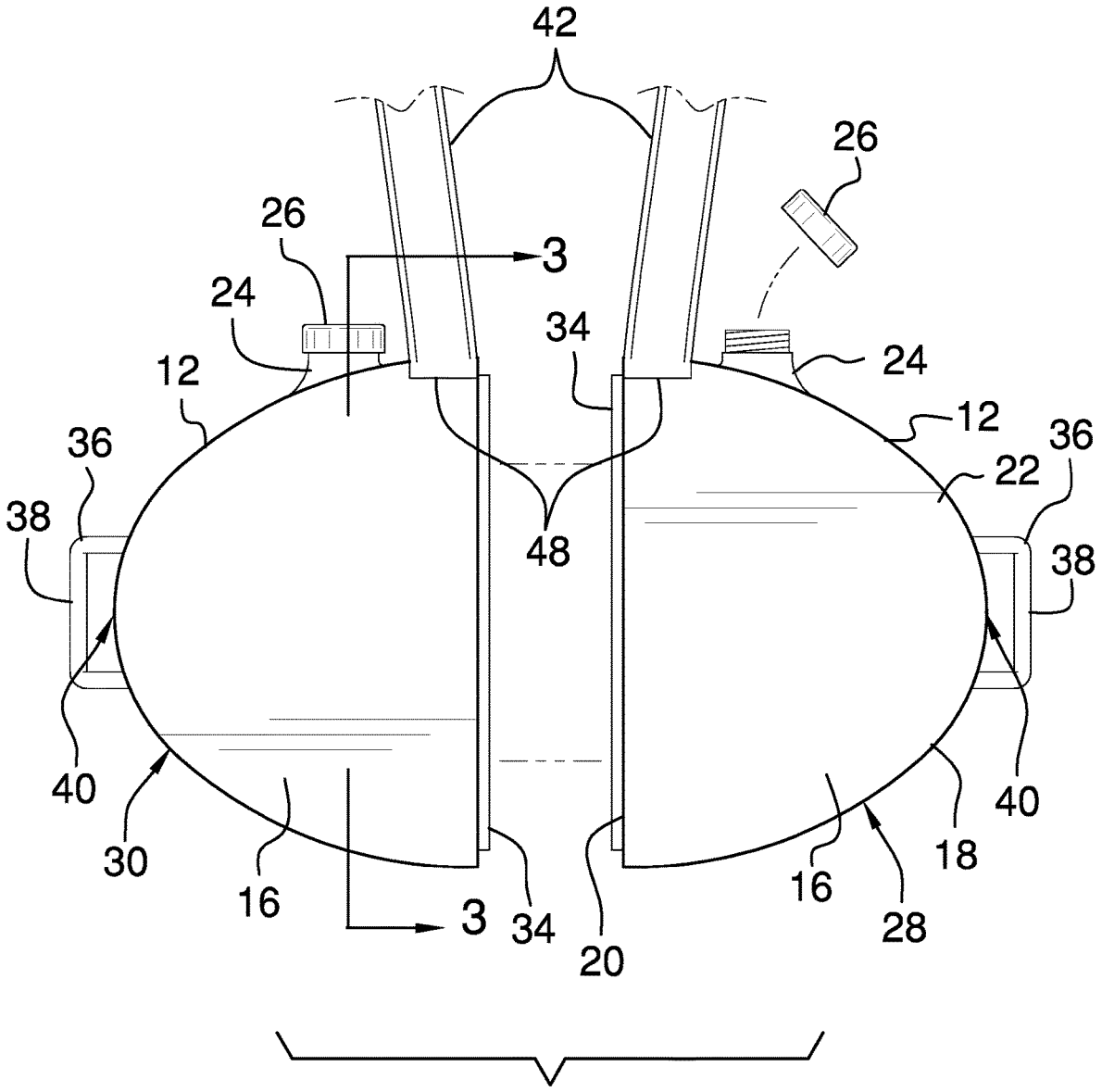
FIG. 2 is a back view of an embodiment of the disclosure.
Figure 3:
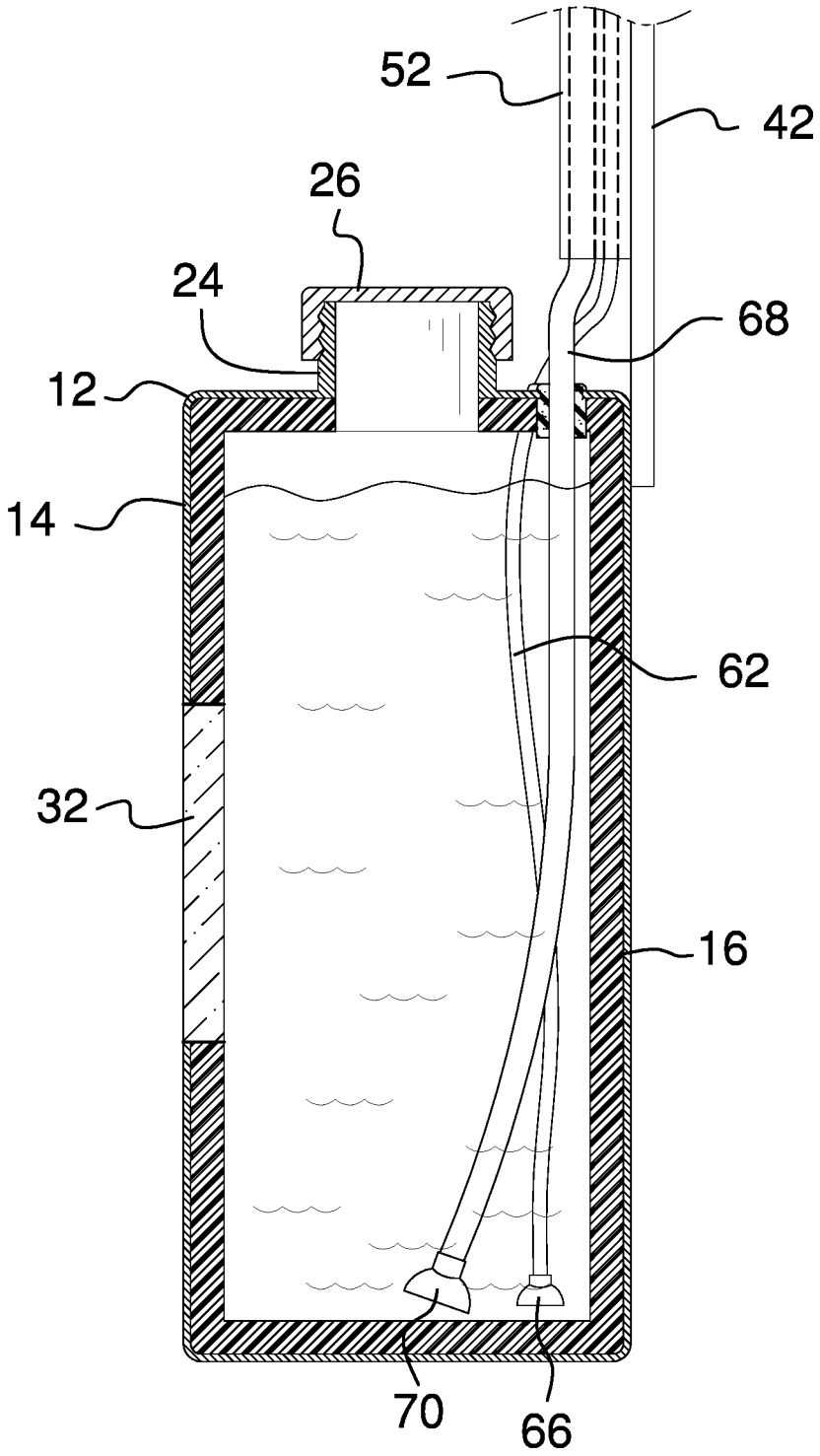
FIG. 3 is a cross sectional view taken along line 3-3 of FIG. 2 of an embodiment of the disclosure.
Figure 4:
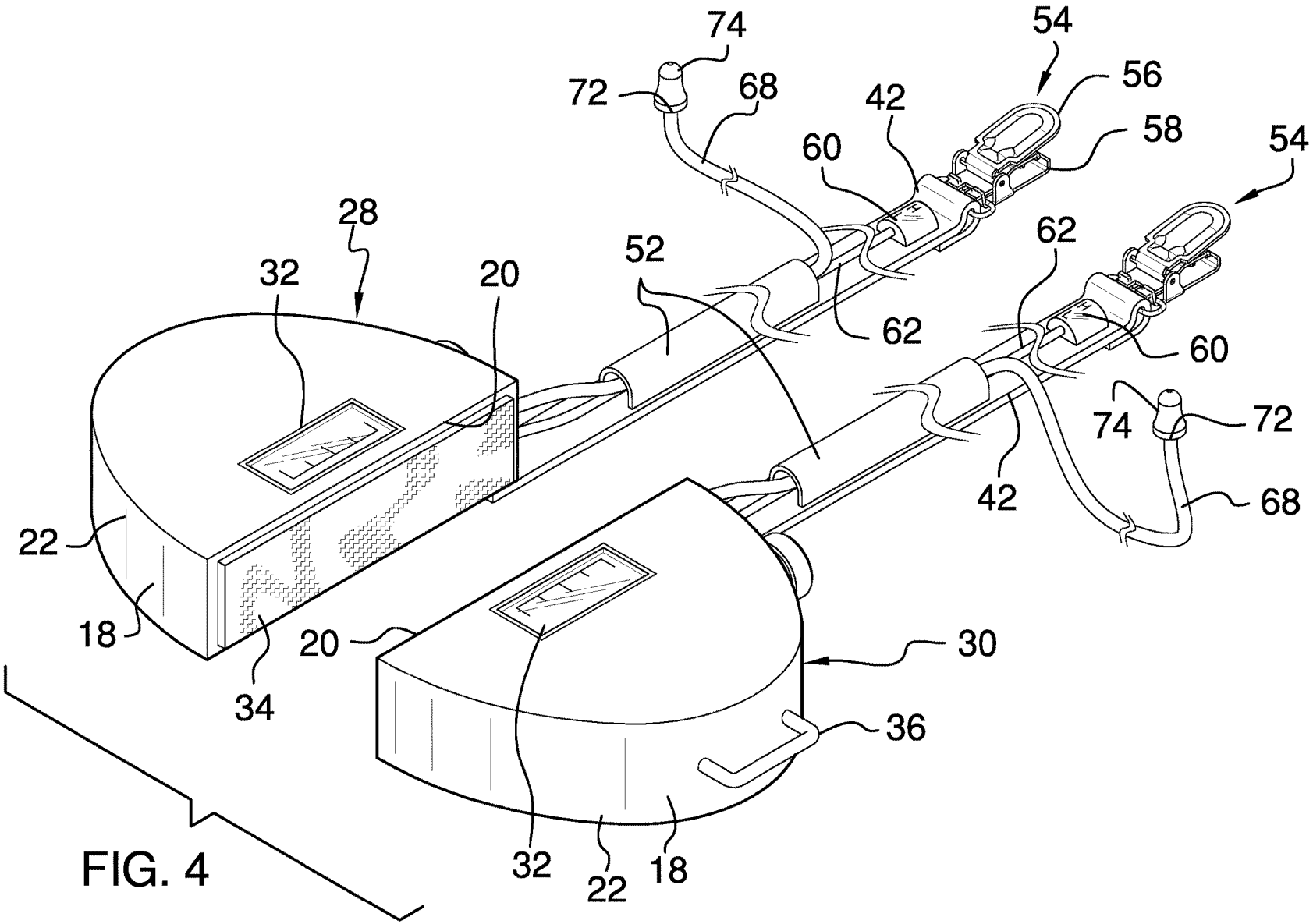
FIG. 4 is a perspective view of an embodiment of the disclosure showing a first reservoir being split from a second reservoir.
Figure 5:
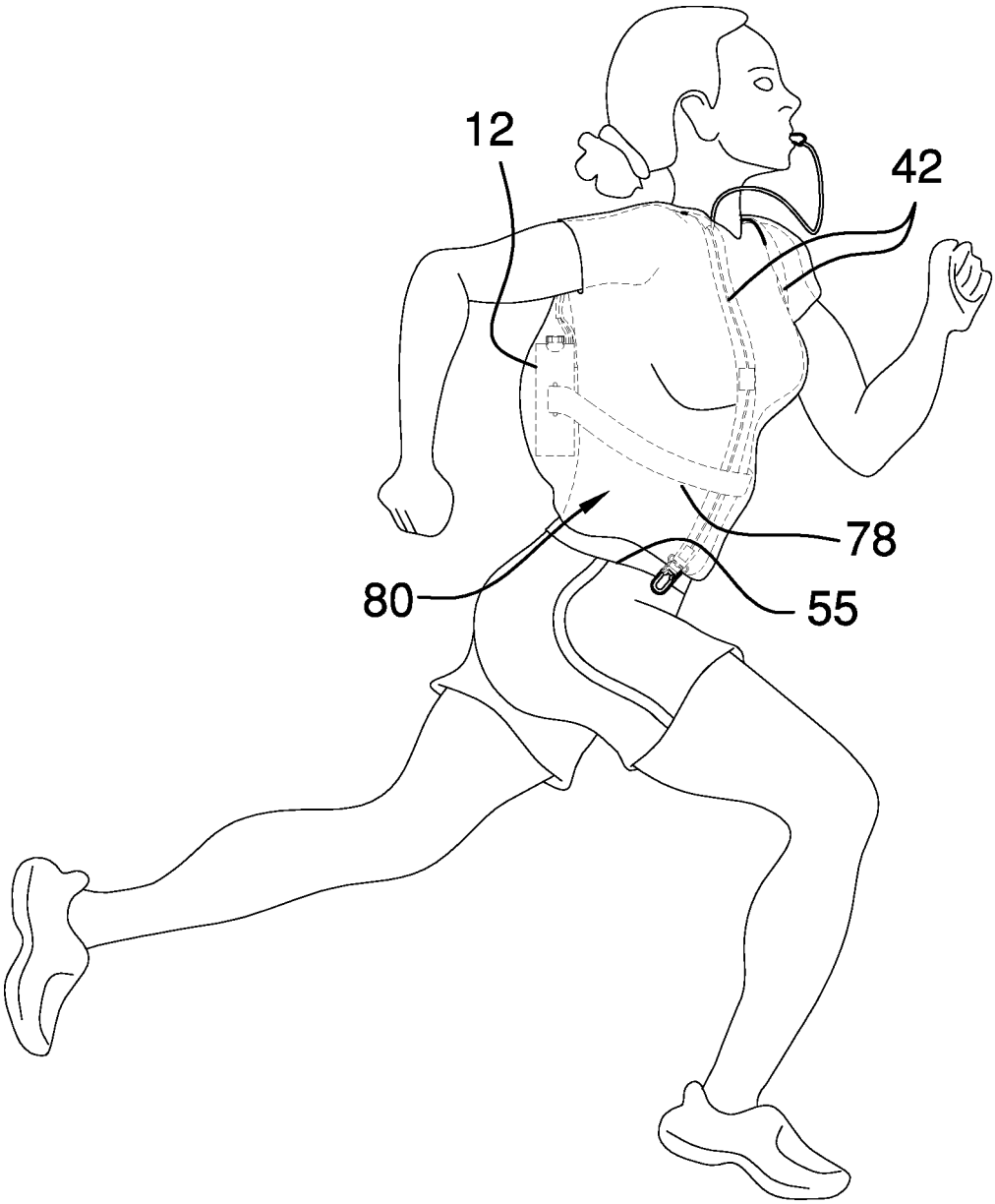
FIG. 5 is a perspective in-use view of an embodiment of the disclosure.

With reference now to the drawings, and in particular to FIGS. 1 through 5 thereof, a new hydration device embodying the principles and concepts of an embodiment of the disclosure and generally designated by the reference numeral 10 will be described.

As best illustrated in FIGS. 1 through 5, the personal hydration assembly 10 generally comprises a pair of reservoirs 12 that each respectively contains water or fluid electrolytes and each of the reservoirs 12 is removably attachable together. Each of the reservoirs 12 has a front wall 14, a back wall 16 and a perimeter wall 18 extending therebetween, and the perimeter wall 18 has a first lateral side 20 and a second lateral side 22. The first lateral side 20 is planar and the second lateral side 22 is concavely arcuate with respect to the first lateral side 20 such that each of the reservoirs 12 has a bullet shaped cross section taken along line extending through the front wall 14 and the back wall 16. Each of the reservoirs 12 has a fill spout 24 extending through the second lateral side 22 into an interior of a respective reservoir 12 for filling the respective reservoir 12 with fluid. A pair of caps 26 is each removably attachable to the fill spout 24 on a respective reservoir 12 for closing the fill spout 24 on the respective reservoir 12.

The pair of reservoirs 12 includes a first reservoir 28 and a second reservoir 30. The first lateral side 20 of the perimeter wall 18 of first reservoir 28 is positioned against the first lateral side 20 of the perimeter wall 18 of the second reservoir 30. Moreover, the first reservoir 28 and the second reservoir 30 define an ovoid shape when the first reservoir 28 and the second reservoir 30 are positioned together. A pair of first level gauges 32 is each coupled to a respective one of the reservoirs 12. Each of the first level gauges 32 is in fluid communication with an interior of the respective reservoir 12 to display the fluid level in the respective reservoir 12. Additionally, each of the first level gauges 32 is positioned on the back wall 16 of the respective reservoir 12. Each of the first level gauges 32 may comprise an analog fluid level gauge or other similar device that can visually indicate fluid levels.

A pair of mating members 34 is each attached to a respective one of the reservoirs 12. The pair of mating members 34 is matable to each other for releasably attaching the reservoirs 12 together. Additionally, each of the mating members 34 is positioned on the first lateral side 20 of the perimeter wall 18 of a respective one of the first reservoir 28 and the second reservoir 30. Each of the mating members 34 may comprise a hook and loop fastener or other type of releasable fastener. A pair of engagements 36 is each coupled to the second lateral side 22 of the perimeter wall 18 of a respective one of the first reservoir 28 and the second reservoir 30. Each of the engagements 36 includes a member 38 that is spaced from the second lateral side 22 and each of the engagements 36 is positioned at an apex 40 of the second lateral side 22.

A pair of shoulder straps 42 is each coupled to a respective one of the reservoirs 12. Each of the shoulder straps 42 can be extended over the user's shoulders 44 thereby facilitating the pair of reservoirs 12 to be worn on the user's back 46. Each of the shoulder straps 42 has a first end 48 and a second end 50, and the first end 48 of each of the shoulder straps 42 is coupled to the second lateral side 22 of the perimeter wall 18 of the respective reservoir 12. A pair of sleeves 52 is each coupled to a first surface 54 of a respective one of the shoulder straps 42. Each of the sleeves 52 is positioned closer to the first end 48 of the respective shoulder strap 42 than the second end 50 of the respective shoulder strap 42. Additionally, each of the sleeves 52 extends substantially between the first end 48 and the second end 50 of the respective shoulder strap 42.

A pair of clamps 54 is provided and each of the clamps 54 is coupled to a respective one of the shoulder straps 42. Each of the clamps 54 can engage a waist band 55 of the user's clothing when the shoulders 44 straps are extended over the user's shoulders 44. Additionally, each of the clamps 54 is positioned on the second end of the respective shoulder strap. Each of the clamps 54 includes a first jaw 56 that is pivotally coupled to a second jaw 58. Moreover, each of the clamps 54 is positionable in a closed position having the first jaw 56 compressing against the second jaw 58 for engaging the waist band 55. Each of the clamps 54 is positionable in an open position has the first jaw 56 is spaced from the second jaw 58.

A pair of second level gauges 60 is each coupled to a respective one of the shoulder straps 42 such that each of the second level gauges 60 is visible to the user when the shoulder straps 42 are extended over the user's shoulders 44. Each of the second level gauges 60 is in fluid communication with an interior of a respective one of the reservoirs 12 to display the fluid level in the respective reservoir 12. Each of the second level gauges 60 may comprise an analog fluid level gauge or other similar device that can visually indicate fluid levels.

A pair of hoses 62 is provided and each of the hoses 62 has a first end 64 and a second end 66. The first end 64 of each of the hoses 62 is fluidly coupled to a respective one of the second level gauges 60. Each of the hoses 62 extends into a respective one of the reservoirs 12 having the second end 66 of each of the hoses 62 being positioned within the respective reservoir 12. In this way each of the hoses 62 delivers fluid in the respective reservoir 12 to the respective second level gauge to facilitate the second level gauge to indicate the fluid level in the respective reservoir 12. Each of the hoses 62 extends through the sleeve 52 on a respective one of the shoulder straps 42.

A pair of drinking tubes 68 is each positioned on a respective one of the shoulder straps 42 such that each of the drinking tubes 68 is accessible to the user when the shoulder straps 42 are worn. Each of the drinking tubes 68 is in fluid communication with a respective one of the reservoirs 12 to receive either the water or the fluid electrolytes thereby facilitating the user to drink either the water or the fluid electrolytes. In this way the user can drink the water and fluid electrolytes individually or simultaneously.

Each of the drinking tubes 68 has a primary end 70 and a secondary end 72. Each of the drinking tubes 68 extends into the respective reservoir 12 such that the primary end 70 of each of the drinking tubes 68 is positioned within the respective reservoir 12. In this way each of the drinking tubes 68 respectively receives the water and the fluid electrolytes. Each of the drinking hoses 62 extends through the sleeve 52 on the respective shoulder strap 42 such that the secondary end 72 of each of the drinking tubes 68 is positioned near the user's mouth. In this way the user can suck on either of the drinking tubes 68 for drinking the water and/or the fluid electrolytes.

A pair of mouthpieces 74 is each fluidly coupled to the secondary end 72 of a respective one of the drinking tubes 68. In this way each of the mouthpieces 74 can be placed in the user's mouth. Each of the mouthpieces 74 is actuated into an open condition when the mouthpieces 74 are compressed. In this way either of the mouthpieces 74 can pass fluid therethrough when the user bites down on either of the mouthpieces 74. A pair of flaps 76 is each coupled to the first surface 54 of a respective one of the shoulder straps 42. Each of the flaps 76 is foldable over respective ones of the hoses 62 and the drinking tubes 68 for securing the respective hose 62 and drinking tube 68. Moreover, each of the flaps 76 is releasably matable to the first surface 54 of the respective shoulder strap 42.

A pair of waist belts 78 is each attached to a respective one of the reservoirs 12. Each of the waist belts 78 can be worn around the user's waist 80 when the shoulder straps 42 are worn over the user's shoulders 44. Each of the waist belts 78 has a coupled end 82, a free end 84 and a primary surface 86 extending therebetween. The coupled end 82 of each of the waist belts 78 is movably coupled to the member 38 on a respective one of the engagements 36. Each of the waist belts 78 is matable together such that the waist belts 78 forms a closed loop of a selected diameter.

In use, each of the reservoirs 12 is respectively filled with water and fluid electrolytes, or any combination of beverages the user might wish to consume. Each of the shoulder straps 42 is worn over the user's shoulders 44 and each of the clamps 54 is clamped to the waist band 55 of the user's clothing. Each of the waist belts 78 is worn around the user's waist 80 to subsequently secure the reservoirs 12 on the user's back. In this way each of the drinking tubes 68 is available to the user for drinking the water and the fluid electrolytes, either individually or simultaneously, depending on the user's preference.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A personal hydration assembly being wearable on a user to deliver either water or electrolytes, depending on the user's preference, said assembly comprising:

a pair of reservoirs each being configured to respectively contain water or fluid electrolytes, each of said reservoirs being removably attachable together;

a pair of first level gauges, each of said first level gauges being coupled to a respective one of said reservoirs, each of said first level gauges being in fluid communication with an interior of said respective reservoir wherein each of said first level gauges is configured to display the fluid level in said respective reservoir;

a pair of mating members, each of said mating members being attached to a respective one of said reservoirs, said pair of mating members being matable to each other for releasably attaching said reservoirs together;

a pair of shoulder straps, each of said shoulders straps being coupled to a respective one of said reservoirs, each of said shoulder straps being configured to be extended over the user's shoulders thereby facilitating said pair of reservoirs to be worn on the user's back;

a pair of clamps, each of said clamps being coupled to a respective one of said shoulder straps wherein each of said clamps is configured to engage a waist band of the user's clothing when said shoulders straps are extended over the user's shoulders;

a pair of second level gauges, each of said second level gauges being coupled to a respective one of said shoulder straps wherein each of said second level gauges is configured to be visible to the user when said shoulder straps are extended over the user's shoulders, each of said second level gauges being in fluid communication with an interior of a respective one of said reservoirs wherein each of said second level gauges is configured to display the fluid level in said respective reservoir;

a pair of drinking tubes, each of said drinking tubes being positioned on a respective one of said shoulder straps wherein each of said drinking tubes is configured to be accessible to the user when said shoulder straps are worn, each of said drinking tubes being in fluid communication with a respective one of said reservoirs wherein each of said drinking tubes is configured to receive either the water or the fluid electrolytes thereby facilitating the user to drink either the water or the fluid electrolytes; and a pair of waist belts, each of said waist belts being attached to a respective one of said reservoirs wherein each of said waist belts is configured to be worn around the user's waist when said shoulder straps are worn over the user's shoulders.

2. The assembly according to claim 1, wherein each of said reservoirs has a front wall, a back wall and a perimeter wall extending therebetween, said perimeter wall having a first lateral side and a second lateral side, said first lateral side being planar, said second lateral side being concavely arcuate with respect to said first lateral side such that each of said reservoirs has a bullet shaped cross section taken along line extending through said front wall and said back wall.

3. The assembly according to claim 2, wherein each of said reservoirs has a fill spout extending through said second lateral side into an interior of a respective reservoir wherein said fill spout on said respective reservoir is configured to fill said respective reservoir with fluid.

4. The assembly according to claim 2, wherein said pair of reservoirs includes a first reservoir and a second reservoir, said first lateral side of said perimeter wall of first reservoir being positioned against said first lateral side of said perimeter wall of said second reservoir such that said first reservoir and said second reservoir define an ovoid shape.

5. The assembly according to claim 4, wherein each of said mating members is positioned on said first lateral side of said perimeter wall of a respective one of said first reservoir and said second reservoir.

6. The assembly according to claim 2, further comprising a pair of engagements, each of said engagements being coupled to said second lateral side of said perimeter wall of a respective one of said first reservoir and said second reservoir, each of said engagements including a member being spaced from said second lateral side, each of said engagements being positioned at an apex of said second lateral side.

7. The assembly according to claim 2, wherein each of said shoulder straps has a first end and a second end, said first end of each of said shoulder straps being coupled to said second lateral side of said perimeter wall of said respective reservoir.

8. The assembly according to claim 7, further comprising a pair of sleeves, each of said sleeves being coupled to a first surface of a respective one of said shoulder straps, each of said sleeves being positioned closer to said first end of said respective shoulder strap than said second end of said respective shoulder strap, each of said sleeves extending substantially between said first end and said second end of said respective shoulder strap.

9. The assembly according to claim 7, wherein each of said clamps is positioned on said second end of said respective shoulder strap, each of said clamps including a first jaw being pivotally coupled to a second jaw, each of said clamps being positionable in a closed position having said first jaw compressing against said second jaw for engaging the waist band, each of said clamps being positionable in an open position having said first jaw being spaced from said second jaw.

10. The assembly according to claim 8, further comprising a pair of hoses, each of said hoses having a first end and a second end, said first end of each of said hoses being fluidly coupled to a respective one of said second level gauges, each of said hoses extending into a respective one of said reservoirs having said second end of each of said hoses being positioned within said respective reservoir wherein each of said hoses is configured to deliver fluid in said respective reservoir to said respective second level gauge to facilitate said second level gauge to indicate the fluid level in said respective reservoir, each of said hoses extending through said sleeve on a respective one of said shoulder straps.

11. The assembly according to claim 8, wherein each of said drinking tubes has a primary end and a secondary end, each of said drinking tubes extending into said respective reservoir such that said primary end of each of said drinking tubes is positioned within said respective reservoir wherein each of said drinking tubes is configured to respectively receive the water and the fluid electrolytes, each of said drinking hoses extending through said sleeve on said respective shoulder strap wherein said secondary end of each of said drinking tubes is configured to be positioned near the user's mouth thereby facilitating the user to suck on either of said drinking tubes.

12. The assembly according to claim 11, further comprising a pair of mouthpieces, each of said mouthpieces being fluidly coupled to said secondary end of a respective one of said drinking tubes wherein each of said mouthpieces is configured to be placed in the user's mouth, each of said mouthpieces being actuated into an open condition when said mouthpieces are compressed wherein either of said mouthpieces is configured to pass fluid therethrough when the user bites down on either of said mouthpieces.

13. The assembly according to claim 7, further comprising a pair of flaps, each of said flaps being coupled to a first surface of a respective one of said shoulder straps, each of said flaps being foldable over respective ones of said hose and said drinking tubes for securing said respective hose and drinking tube, each of said flaps being releasably matable to said first surface of said respective shoulder strap.

14. The assembly according to claim 6, wherein each of said waist belts has a coupled end, a free end and a primary surface extending therebetween, said coupled end of each of said waist belts being movably coupled to said member on a respective on of said engagements, each of said waist belts being matable together such that said waist belts forms a closed loop of a selected diameter.

15. A personal hydration assembly being wearable on a user to deliver either water or electrolytes, depending on the user's preference, said assembly comprising:

a pair of reservoirs each being configured to respectively contain water or fluid electrolytes, each of said reservoirs being removably attachable together, each of said reservoirs having a front wall, a back wall and a perimeter wall extending therebetween, said perimeter wall having a first lateral side and a second lateral side, said first lateral side being planar, said second lateral side being concavely arcuate with respect to said first lateral side such that each of said reservoirs has a bullet shaped cross section taken along line extending through said front wall and said back wall, each of said reservoirs having a fill spout extending through said second lateral side into an interior of a respective reservoir wherein said fill spout on said respective reservoir is configured to fill said respective reservoir with fluid, said pair of reservoirs including a first reservoir and a second reservoir, said first lateral side of said perimeter wall of first reservoir being positioned against said first lateral side of said perimeter wall of said second reservoir such that said first reservoir and said second reservoir define an ovoid shape;

a pair of first level gauges, each of said first level gauges being coupled to a respective one of said reservoirs, each of said first level gauges being in fluid communication with an interior of said respective reservoir wherein each of said first level gauges is configured to display the fluid level in said respective reservoir, each of said first level gauges being positioned on said back wall of said respective reservoir;

a pair of mating members, each of said mating members being attached to a respective one of said reservoirs, said pair of mating members being matable to each other for releasably attaching said reservoirs together, each of said mating members being positioned on said first lateral side of said perimeter wall of a respective one of said first reservoir and said second reservoir;

a pair of engagements, each of said engagements being coupled to said second lateral side of said perimeter wall of a respective one of said first reservoir and said second reservoir, each of said engagements including a member being spaced from said second lateral side, each of said engagements being positioned at an apex of said second lateral side;

a pair of shoulder straps, each of said shoulders straps being coupled to a respective one of said reservoirs, each of said shoulder straps being configured to be extended over the user's shoulders thereby facilitating said pair of reservoirs to be worn on the user's back, each of said shoulder straps having a first end and a second end, said first end of each of said shoulder straps being coupled to said second lateral side of said perimeter wall of said respective reservoir;

a pair of sleeves, each of said sleeves being coupled to a first surface of a respective one of said shoulder straps, each of said sleeves being positioned closer to said first end of said respective shoulder strap than said second end of said respective shoulder strap, each of said sleeves extending substantially between said first end and said second end of said respective shoulder strap;

a pair of clamps, each of said clamps being coupled to a respective one of said shoulder straps wherein each of said clamps is configured to engage a waist band of the user's clothing when said shoulders straps are extended over the user's shoulders, each of said clamps being positioned on said second end of said respective shoulder strap, each of said clamps including a first jaw being pivotally coupled to a second jaw, each of said clamps being positionable in a closed position having said first jaw compressing against said second jaw for engaging the waist band, each of said clamps being positionable in an open position having said first jaw being spaced from said second jaw;

a pair of second level gauges, each of said second level gauges being coupled to a respective one of said shoulder straps wherein each of said second level gauges is configured to be visible to the user when said shoulder straps are extended over the user's shoulders, each of said second level gauges being in fluid communication with an interior of a respective one of said reservoirs wherein each of said second level gauges is configured to display the fluid level in said respective reservoir;

a pair of hoses, each of said hoses having a first end and a second end, said first end of each of said hoses being fluidly coupled to a respective one of said second level gauges, each of said hoses extending into a respective one of said reservoirs having said second end of each of said hoses being positioned within said respective reservoir wherein each of said hoses is configured to deliver fluid in said respective reservoir to said respective second level gauge to facilitate said second level gauge to indicate the fluid level in said respective reservoir, each of said hoses extending through said sleeve on a respective one of said shoulder straps;

a pair of drinking tubes, each of said drinking tubes being positioned on a respective one of said shoulder straps wherein each of said drinking tubes is configured to be accessible to the user when said shoulder straps are worn, each of said drinking tubes being in fluid communication with a respective one of said reservoirs wherein each of said drinking tubes is configured to receive either the water or the fluid electrolytes thereby facilitating the user to drink either the water or the fluid electrolytes, each of said drinking tubes having a primary end and a secondary end, each of said drinking tubes extending into said respective reservoir such that said primary end of each of said drinking tubes is positioned within said respective reservoir wherein each of said drinking tubes is configured to respectively receive the water and the fluid electrolytes, each of said drinking hoses extending through said sleeve on said respective shoulder strap wherein said secondary end of each of said drinking tubes is configured to be positioned near the user's mouth thereby facilitating the user to suck on either of said drinking tubes;

a pair of mouthpieces, each of said mouthpieces being fluidly coupled to said secondary end of a respective one of said drinking tubes wherein each of said mouthpieces is configured to be placed in the user's mouth, each of said mouthpieces being actuated into an open condition when said mouthpieces are compressed wherein either of said mouthpieces is configured to pass fluid therethrough when the user bites down on either of said mouthpieces;

a pair of flaps, each of said flaps being coupled to said first surface of a respective one of said shoulder straps, each of said flaps being foldable over respective ones of said hose and said drinking tubes for securing said respective hose and drinking tube, each of said flaps being releasably matable to said first surface of said respective shoulder strap; and a pair of waist belts, each of said waist belts being attached to a respective one of said reservoirs wherein each of said waist belts is configured to be worn around the user's waist when said shoulder straps are worn over the user's shoulders, each of said waist belts having a coupled end, a free end and a primary surface extending therebetween, said coupled end of each of said waist belts being movably coupled to said member on a respective on of said engagements, each of said waist belts being matable together such that said waist belts forms a closed loop of a selected diameter.

* * * * *